US012692563B2

(12) United States Patent
Hyllander et al.

(10) Patent No.: US 12,692,563 B2
(45) Date of Patent: Jul. 28, 2026

(54) PROCESS FOR THE PRODUCTION OF CARBURIZED SPONGE IRON

(71) Applicant: HYBRIT Development AB, Stockholm (SE)

(72) Inventors: Jenny Anna Gunilla Hyllander, Södra Sunderbyn (SE); Magnus Tottie, Gällivare (SE)

(73) Assignee: HYBRIT Development AB, Stockholm (SE)

( * ) Notice: Subject to any disclaimer, the term of this patent is extended or adjusted under 35 U.S.C. 154(b) by 727 days.

(21) Appl. No.: 17/922,842

(22) PCT Filed: May 3, 2021

(86) PCT No.: PCT/SE2021/050410
§ 371 (c)(1),
(2) Date: Nov. 2, 2022

(87) PCT Pub. No.: WO2021/225500
PCT Pub. Date: Nov. 11, 2021

(65) Prior Publication Data

US 2023/0160028 A1 May 25, 2023

(30) Foreign Application Priority Data

May 4, 2020 (SE) ..... 2050508-7

(51) Int. Cl.
*C21B 13/00* (2006.01)
*C21B 13/02* (2006.01)
(Continued)

(52) U.S. Cl.
CPC ..... *C21B 13/0073* (2013.01); *C21B 13/004* (2013.01); *C21B 13/02* (2013.01);
(Continued)

(58) Field of Classification Search
CPC ... C21B 13/0073; C21B 13/004; C21B 13/02; C21B 13/146; C21B 2100/24;
(Continued)

(56) References Cited

U.S. PATENT DOCUMENTS 4,150,972 A 4/1979 Price-Falcon et al.
4,216,011 A 8/1980 Martinez Vera et al.
(Continued)

FOREIGN PATENT DOCUMENTS

CA 3103187 A1 12/2019
CN 101269315 A 9/2008
(Continued)

OTHER PUBLICATIONS

A. Markotic, et.al. ["State of the Direct Reduction and Reduction Smelting Processes", Journal of Mining and Metallurgy, 38 (3-4) B (2002) 123-141] (Year: 2002).*
(Continued)

*Primary Examiner* — Sally A Merkling
*Assistant Examiner* — Nazmun Nahar Shams
(74) *Attorney, Agent, or Firm* — MARSHALL, GERSTEIN & BORUN LLP

(57) ABSTRACT

The present disclosure relates to a process for the production of carburized sponge iron. The process comprises the steps of reducing iron ore pellets using a carbon-lean reducing gas in a direct reduction shaft reactor to provide a sponge iron intermediate; transferring the sponge iron intermediate to a carburization unit; and carburizing the sponge iron intermediate in the carburization unit using a carburizing gas to provide carburized sponge iron. The disclosure further relates to a system for the production of carburized sponge iron, a carburized sponge iron produced by the aforementioned process, and a sponge iron intermediate obtained during the production of such a carburized sponge iron.

10 Claims, 6 Drawing Sheets

(51) Int. Cl.
*C21B 13/14* (2006.01)
*C25B 1/04* (2021.01)

(52) U.S. Cl.
CPC ..... *C21B 13/146* (2013.01); *C25B 1/04* (2013.01); *C21B 2100/24* (2017.05); *C21B 2100/282* (2017.05); *C21B 2100/66* (2017.05)

(58) Field of Classification Search
CPC ..... C21B 2100/282; C21B 2100/66; C21B 2100/26; C21B 2100/64; C01B 3/02; C01B 2203/0405; C01B 2203/043; C01B 2203/06; C01B 3/50; C25B 1/04; C25B 15/08; Y02E 60/36; Y02P 10/122; Y02P 10/20; Y02P 10/134; Y02P 10/143; Y02P 10/32
USPC ..... 75/489
See application file for complete search history.

(56) References Cited

U.S. PATENT DOCUMENTS

| | | | | |
|---|---|---|---|---|
| 4,834,792 | A | 5/1989 | Becerra-Novoa | |
| 6,599,374 | B1 | 7/2003 | Hirsch et al. | |
| 12,180,554 | B2 * | 12/2024 | Boehm | C21B 13/0093 |
| 2015/0259759 | A1 | 9/2015 | Wolfmeir et al. | |
| 2015/0329931 | A1 | 11/2015 | Eder et al. | |
| 2017/0298461 | A1 | 10/2017 | Eder et al. | |
| 2021/0238700 | A1 | 8/2021 | Gehrmann et al. | |
| 2021/0246521 | A1 | 8/2021 | Boehm et al. | |
| 2022/0235426 | A1 * | 7/2022 | Duarte Escareño | C21B 13/026 |

FOREIGN PATENT DOCUMENTS

| | | | |
|---|---|---|---|
| CN | 101701274 | A | 5/2010 |
| CN | 104087702 | A | 10/2014 |
| CN | 104662176 | A | 5/2015 |
| CN | 107653353 | A | 2/2018 |
| DE | 102018202594 | A1 | 8/2019 |
| DE | 102018209042 | A1 | 12/2019 |
| EP | 3581663 | A1 | 12/2019 |
| JP | S63-114913 | A | 5/1988 |
| RU | 2590029 | C1 | 7/2016 |

OTHER PUBLICATIONS

Swedish Patent Application No. 2050508-7, Office Action, dated May 17, 2023.
Ahmad, Meltin of a new carbon-free waxed sponge iron in Electric Arc Furnace (EAF) for steelmaking, International Journal of Materials Science and Applications, 4(2-1):1-6 (2015).
Chinese Patent Application No. 202180032603.8, Office Action, issued Nov. 1, 2024.
International Preliminary Report on Patentability for Corresponding International Application No. PCT/SE2021/050410, mailing date Nov. 17, 2022.
Zhang et al., Non-blast furnace ironmaking, Metallurgical Industry Press (Mar. 2015).
Chinese Patent Application No. 202180032603.8, Second Office Action, dated Feb. 19, 2025.
Brozek et al., Briquetting of chips from nonferrous metal, Engineering for Rural Development, pp. 236-241 (2010).
Japanese Patent Application No. 2023-511767, Notice of Reasons for Refusal, dated Mar. 7, 2025.
Swedish Search Report, Swedish Application No. 2050508-7, mailed on Nov. 9, 2020.
Vogl et al., Assessment of hydrogen direct reduction for fossil-free steelmaking, In: Journal of Cleaner Production, 2018, No. 203, pp. 736-745; p. 740, col. 2, paragraph [0003]—p. 741, col. 1, paragraph [0001]; p. 738, line 2; figure 1.
Jaleel K. A., Melting of a New Carbon—Free Waxed Sponge Iron in Electric Arc Furnace (EAF) for Steelmaking, In: International Journal of Materials Science and Applications; Special Issue: Steel and Direct Reduced Iron (sponge Iron) Industry, 2015, vol. 4, No. 2-1, pp. 1-6; p. 2, col. 1—p. 2, col. 1; p. 3, col. 1, paragraph [0003]—p. 3, col. 1, paragraph [0003]; p. 3, col. 2, paragraph [0004]—p. 3, col. 2, paragraph [0004]; Section 2.1.
Swedish Office Action, Swedish Application No. 2050508-7, mailed on Jan. 31, 2022.
International Search Report and Written Opinion, International Application No. PCT/SE2021/050410, mailed on Jun. 28, 2021.

* cited by examiner

PROCESS FOR THE PRODUCTION OF CARBURIZED SPONGE IRON

CROSS REFERENCE TO RELATED APPLICATION

This application is a U.S. national phase of International Patent Application No. PCT/SE2021/050410 filed May 3, 2021, which claims the benefit of priority from Sweden patent application no. 2050508-7 filed May 4, 2020, the respective disclosures of which are each incorporated herein by reference in their entireties.

TECHNICAL FIELD

The present disclosure relates to a process for the production of carburized sponge iron. The disclosure further relates to a system for the production of carburized sponge iron, a carburized sponge iron produced by the aforementioned process, and a sponge iron intermediate obtained during the production of such a carburized sponge iron.

BACKGROUND ART

Steel is the world's most important engineering and construction material. It is difficult to find any object in the modern world that does not contain steel, or depend on steel for its manufacture and/or transport. In this manner, steel is intricately involved in almost every aspect of our modern lives.

In 2018, the total global production of crude steel was 1 810 million tonnes, by far exceeding any other metal, and is expected to reach 2 800 million tonnes in 2050 of which 50% is expected to originate from virgin iron sources. Steel is also the world's most recycled material with a very high recycling grade due to the metals' ability to be used over and over again after remelting, using electricity as the primary energy source.

Thus, steel is a cornerstone of modern society with an even more significant role to play in the future.

Steel is mainly produced via three routes:

i) Integrated production using virgin iron ores in a blast furnace (BF), where iron oxide in the ore is reduced by carbon to produce iron. The iron is further processed in the steel plant by oxygen blowing in a basic oxygen furnace (BOF), followed by refining to produce steel. This process is commonly also referred to as 'oxygen steelmaking'.

ii) Scrap-based production using recycled steel, which is melted in an electric arc furnace (EAF) using electricity as the primary source of energy. This process is commonly also referred to as 'electric steelmaking'.

iii) Direct reduction production based on virgin iron ore, which is reduced in a direct reduction (DR) process with a carbonaceous reducing gas to produce sponge iron. The sponge iron is subsequently melted together with scrap in an EAF to produce steel.

The term crude iron is used herein to denote all irons produced for further processing to steel, regardless of whether they are obtained from a blast furnace (i.e. pig iron), or a direct reduction shaft (i.e. sponge iron).

Although the above-named processes have been refined over decades and are approaching the theoretical minimum energy consumption, there is one fundamental issue not yet resolved. Reduction of iron ore using carbonaceous reductants results in the production of CO2 as a by-product. For every ton steel produced in 2018, an average of 1.83 tonnes of CO2 were produced. The steel industry is one of the highest CO2-emitting industries, accounting for approximately 7% of CO2 emissions globally. Excessive CO2-generation cannot be avoided within the steel production process as long as carbonaceous reductants are used.

The HYBRIT initiative has been founded to address this issue. HYBRIT, short for HYdrogen BReakthrough Ironmaking Technology—is a joint venture between SSAB, LKAB and Vattenfall, funded in part by the Swedish Energy Agency, and aims to reduce CO2 emissions and de-carbonize the steel industry.

Central to the HYBRIT concept is a direct reduction based production of sponge iron from virgin ore. However, instead of using carbonaceous reductant gases, such as natural gas, as in present commercial direct reduction processes, HYBRIT proposes using hydrogen gas as the reductant, termed hydrogen direct reduction (H-DR). The hydrogen gas may be produced by electrolysis of water using mainly fossil-free and/or renewable primary energy sources, as is the case for e.g. Swedish electricity production. Thus, the critical step of reducing the iron ore may be achieved without requiring fossil fuel as an input, and with water as a by-product instead of CO2. The resulting crude iron will naturally also be lacking in carbon.

Iron produced by present-day commercial blast furnace or direct reduction routes typically comprises significant amounts of carbon (typically up to 5 wt %), due to carbon incorporation during reduction of the iron ore. Besides its use as a reducing agent, carbon plays further important roles in the steel-making process. Its presence in the crude iron from the BF or DR process lowers the melting point of the iron. During subsequent processing of the crude iron in an EAF or BOF, the exothermic dissociation of iron carbide and oxidation of carbon to CO supplies heat to the process. The gas evolution in the EAF due to this CO production provides a foamy slag that assists in thermally insulating the iron melt and helps diminish consumption of the EAF electrodes. For at least these reasons, the presence of carbon in the crude iron may assist in reducing energy consumption during processing to steel. The presence of carbon in the melt may also influence slag-metal reaction kinetics, and assist in purging dissolved gaseous elements from the metal. Moreover, the presence of carbon in direct reduced iron passivizes the sponge iron and enables simpler handling and transport. Finally, since the steel industry has a heritage and established practice with respect to carbon-containing crude iron, there may simply be a degree of reluctance among some steelmakers to adopt the use of carbon-lean crude iron, regardless of any benefits.

For at least these reasons, it may be desirable to provide a crude iron produced using substantially fossil-free means, but still containing carbon to an extent that it may be used as a drop-in replacement for present-day crude iron.

Document US 2015/0259760 A1 describes a method for producing steel in which iron ore is reduced with hydrogen and the resulting intermediate product of reduced iron ore and possibly accompanying substances is subjected to further metallurgical processing. In reducing the iron ore to produce the intermediate product, a carbon-containing or hydrogen-containing gas is added to the hydrogen in order to incorporate carbon into the intermediate product. The ratio of hydrogen to carbon-containing or hydrogen-containing gas flows can be continuously varied as a function of availability. For example, if a very large amount of hydrogen is available, this can be used up to almost 100% for the direct reduction. The rest is made up of the minimally required carbon-containing or hydrogen-containing gas flow for adjusting the percentage of carbon. The hydrogen for the reduction has at least enough carbon-containing or hydrogen-containing gas added to it to make the carbon content in the intermediate product 0.0005 mass % to 6.3 mass %, preferably 1% to 3%. It is stated that an intermediate product of this kind is ideally adjusted in terms of the carbon content and is particularly well suited to further processing since it contributes the carbon content that is required for the metallurgical process. Examples of the carbon-containing or hydrogen-containing gas include natural gas, biogas, gas from pyrolysis, and renewable resources.

There remains a need for a means of producing a carbon-containing crude iron in a more environmentally friendly manner.

SUMMARY OF THE INVENTION

The inventors of the present invention have identified a number of shortcomings with prior art means of providing a carbon-containing crude iron. Present-day commercial processes require extensive use of carbonaceous fossil fuels such as coal or natural gas, leading to excessive CO2 emissions. Even in proposed processes to address such issues, a substantial proportion of the carbon-containing gas will still be oxidized to CO2 by contact with the ore. This will be the case irrespective of whether the carbon-containing gas is from a renewable source, or whether fossil fuels are used in compensating for fluctuations in renewable hydrogen availability, as envisaged in the prior art. Such a process will thereby have difficulty in utilizing a substantial proportion of the carbon introduced into the process. The produced CO2 will either be emitted or will accumulate in the process gas if the process gas is to be recycled. In order to prevent CO2 accumulation in the process gas, extensive treatment of the gas will be required to separate CO2. Even if this separated CO2 may be reformed and re-utilized, the cost will be significant.

It would be advantageous to achieve a means of overcoming, or at least alleviating, at least some of the above mentioned shortcomings. In particular, it would be desirable to provide a means of producing a crude iron containing an adequate amount of carbon such that it may be used as drop-in replacement for present-day crude irons, wherein the means of production more effectively utilizes any carbon-containing resources required for production. To better address one or more of these concerns, a process for the production of carburized sponge iron having the features defined in the appended independent claims is provided.

The process comprises the following steps. Iron ore is reduced using a carbon-lean reducing gas in a direct reduction shaft, in order to provide a sponge iron intermediate. By carbon-lean reducing gas it is meant that no carbon reductant is introduced into the reducing gas circuit. The sponge iron intermediate is transferred to a carburization unit, where it is carburized using a carburizing gas to provide carburized sponge iron. The carburization unit may for example be a carburization shaft.

By performing the carburization separately to the reduction, a number of advantages are obtained. Primarily, because the sponge iron intermediate entering the carburization unit is already reduced to a significant degree, the carburization gas will not be oxidized to CO2 by contact with iron oxide to the same degree. Preventing the carburizing gas from being oxidized to CO2 means that more carbon of the carburizing gas is available to participate in carburizing reactions, leading to a higher utilization of the carbon in the carburizing gas. The carburizing gas circuit is separate from the reducing gas circuit. Because of this, the carburization gas circuit may be smaller in dimension than a combined reduction and carburizing gas circuit. This means that treatment and re-use of the spent carburization off-gas is facilitated and the carburization gas is easier to maintain in a state optimal for carburization. Due to the improved utilization of the carburization gas for carburization as opposed to reduction, there is also a greater range of carburization gases that are feasible to use, from both an availability and cost perspective. Handling of the reducing gas circuit is also simplified. Because there is essentially no CO2 in the reducing gas, there is no need for a CO2 separation stage in the treatment of the spent top-gas prior to recycling of the top-gas to the direct reduction shaft.

The carburizing gas may be derived from a renewable source. This is possible due to the high utilization of the carburizing gas, and means that net CO2 emissions from the process may be decreased further. For example, the carburizing gas may comprise or consist essentially of bio-methane, biogas, gas from the pyrolysis of biomass, or combinations thereof.

The reducing gas may comprise or consist essentially of hydrogen produced by electrolysis, i.e. the make-up gas added to the reducing gas circuit may comprise or consist essentially of hydrogen produced by electrolysis. The hydrogen produced by electrolysis may be produced in part or fully using electricity from renewable and/or fossil-free sources. Thus, the direct and/or indirect CO2 emissions of the process may be further decreased. If both the reduction and carburization steps are performed using fossil-free and/or renewable sources, the net CO2 emissions are very low for the entire process.

Hydrogen may be separated from an off-gas from the carburization unit. This hydrogen may include hydrogen produced during the carburizing step, as well as any hydrogen introduced as a component portion of the carburizing gas. This assists in preventing accumulation of hydrogen in the recycled process gases of the carburization stage. This hydrogen may be introduced as reducing gas into the direct reduction shaft. This may assist in decreasing the energy requirements for performing the reduction step and help ensure that even the hydrogen content of the carburization gas is utilized effectively.

Carbon dioxide produced in the carburizing step may be separated from an off-gas from the carburization unit. This prevents accumulation of CO2 in the recycled process gases in the carburization stage. This carbon dioxide may be converted into carbon monoxide and re-introduced as a carburizing gas into the carburization unit. Alternatively, or in addition, the carbon dioxide may be converted into methane and re-introduced as a carburizing gas into the carburization unit. This helps ensure a very high utilization of the carbon in the carburization gas.

The carburization gas may be pre-heated by heat exchange with an off-gas from the carburization unit. This decreases the overall energy requirements of the process. Alternatively, or in addition, the carburizing gas may be mixed with an off-gas from the carburization unit prior to introduction into the carburization unit.

The sponge iron intermediate may be transferred to the carburization unit at a temperature in excess of about 500° C., such as a temperature in excess of 600° C. or a temperature in excess of 700° C. This decreases the need for heating of the carburization reaction and lowers the overall energy requirements of the process.

The sponge iron intermediate may have a degree of reduction greater than about 90%. That is to say that the reduction may be performed to near-completion in the direct reduction shaft. This helps ensure that very little of the carburization gas will be oxidized to CO2 and may potentially allow for good utilization of the carbon in the carburization gas without the need for reforming CO2 produced in the carburization step.

Alternatively, the sponge iron intermediate may have a degree of reduction from about 50% to about 90%, preferably from about 60% to about 80%, such as about 70%. That is to say that the reduction may be performed to a lesser degree in the direct reduction shaft. This allows the hydrogen produced as a by-product of carburization reactions to be consumed as a reductant in the carburization unit. Thus, there may be a lesser need for separation and re-use of the hydrogen by-product and the plant may be dimensioned accordingly. This could also be beneficial from an energy perspective if the availability of fossil-free and/or renewable electricity is for instance fluctuating or is limited for a period. The reduction in the direct reduction shaft could be performed to a lesser degree, meaning that less hydrogen will be needed to produce the intermediate product, and the final reduction and carburization could be performed in the carburization unit with the available fossil-free gases. This would lead to a more flexible (and more dynamically responsive) production plant and would limit the need for a large storage of hydrogen to compensate for fluctuations (due to e.g. weather or otherwise) in the production of fossil-free and/or renewable electricity.

According to another aspect of the invention, the objects of the invention are achieved by a system for the production of carburized sponge iron according to the appended independent claims. The production process may be a process as defined in the appended independent claims, and the carburized sponge iron may be a carburized sponge iron as defined in the appended independent claims.

The system comprises an electrolyser arranged to produce hydrogen from the electrolysis of water; a direct reduction shaft; and a carburization unit. The carburization unit may for example be a carburization shaft.

Such a system allows for a beneficial production of carburized sponge iron as described herein.

The electrolyser may be arranged in fluid communication with the direct reduction shaft, such that hydrogen produced by the electrolyser may be conveyed to the direct reduction shaft. This may preferably be an indirect fluid communication via treatment of the electrolysis gases and/or via a hydrogen storage facility.

An outlet of the direct reduction shaft may be arranged in connection with an inlet of the carburization unit such that sponge iron intermediate may be fed directly from the outlet to the inlet. The system may further comprise a means of conveying sponge iron from the direct reduction shaft to the carburization unit. The exact conveying means used will depend on parameters such as the operating pressure of the direct reduction shaft, as well as requirements concerning how gastight the various units used in the process must be. The conveying means may for example be a passive means such as a chute arranged between an outlet of the direct reduction shaft and an inlet of the carburization unit, or it may be an active means such as a conveyor.

According to a further aspect of the invention, the object of the invention is achieved by a carburized sponge iron according to the appended claims. The carburized sponge iron may be produced by a process according to the appended independent claims. The carburized sponge iron has a degree of reduction greater than 90%, such as greater than 94%, and comprises from 0.5 to 5 percent carbon by weight, such as from 1 to 4 percent carbon by weight such as about 3 percent carbon by weight. The carburized sponge iron has a radiocarbon age of less than 10 000 years before present, preferably less than 1000 years before present, even more preferably less than 100 years before present. This means that the carburized sponge iron must have been carburized using a carburization gas containing a significant renewable carbon content, which as described herein is commercially feasible using the process described herein.

The mass fraction of carbon present as cementite may be greater than 50%, preferably greater than 70%, even more preferably greater than 90%. A high degree of cementite is preferable as cementite typically reaches the melt during further processing and is not lost as dust prior to reaching the melt, as graphite is prone to.

The carburized sponge iron may be in the form of pellets (i.e. DRI) or briquettes (i.e. HBI).

According to yet another aspect of the invention, a sponge iron intermediate is provided. The sponge iron intermediate may be an intermediate in the process as defined in the appended independent claims. The sponge iron intermediate is in the form of pellets. It has a degree of reduction of from about 50% to about 100%, such as from about 50% to about 90% (preferably from about 60% to about 80%), or such as greater than about 90% (preferably greater than 94%). It has a carbon content of less than 0.5% by weight, such as less than 0.2% by weight, preferably less than 0.05% by weight, even more preferably less than 0.0005% by weight. For example, the sponge iron intermediate may have a degree of reduction of from about 60% to about 90% (preferably from about 60% to about 80%) and a carbon content of less than 0.05% by weight (preferably less than 0.0005% by weight). The very low carbon content is due to the carbon-lean reduction process by which it is produced.

Further objects, advantages and novel features of the present invention will become apparent to one skilled in the art from the following detailed description.

BRIEF DESCRIPTION OF THE DRAWINGS

For a fuller understanding of the present invention and further objects and advantages of it, the detailed description set out below should be read together with the accompanying drawings, in which the same reference notations denote similar items in the various diagrams, and in which.

DETAILED DESCRIPTION

Figure 1:
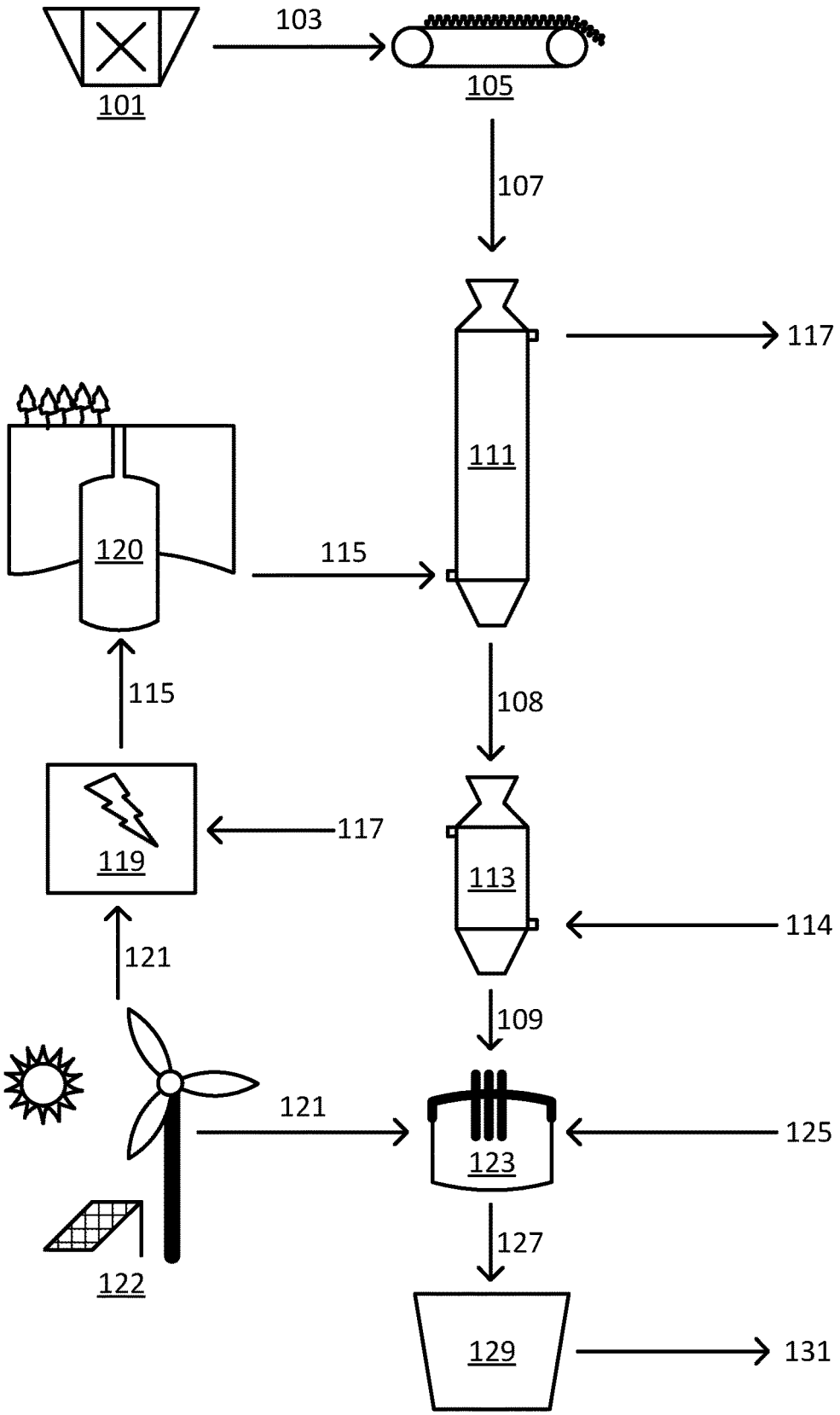
FIG. 1 schematically illustrates an ore-based steelmaking value chain according to the Hybrit concept.

In traditional commercial direct reduction processes, the iron ore is reduced and carburized in a direct reduction shaft. The gas used for reduction and carburization is typically syngas obtained from reformed hydrocarbons using an external reformer, as in the Midrex process, and/or natural gas that is converted by internal reformation, as in the Hyl ZR process. The resulting sponge iron usually comprises from about 2% by weight to about 4.5% by weight carbon, depending on the process used. The carbon is present as a mixture of graphite and iron carbides, where cementite ($Fe_3C$) is the predominant iron carbide. For reference, pure cementite contains 6.69% carbon by weight. A high proportion of iron carbide in the sponge iron is desirable, as graphite contained in the sponge iron is prone to loss as dust during handling and processing of the sponge iron.

Carbonaceous gas introduced into the direct reduction shaft may partake in a number of competing reforming, reducing, and/or carburizing reactions. Such reactions are exemplified below.

Reformation

| | |
|---|---|
| CH4 + H20 → CO + 3H2 | +205.9 kJ/mol |
| CH4 + CO2 → 2CO + 2H2 | +247.1 kJ/mol |

Reduction

| | |
|---|---|
| 3Fe2O3 (hematite) + CO → 2Fe3O4 + CO2 | −24.9 kJ/mol |
| 2Fe3O4 (magnetite) + 2CO → 6FeO + 2CO2 | +45.3 kJ/mol |
| 6FeO (wüstite) + 6CO → 6Fe + 6CO2 | −75.8 kJ/mol |

Carburization (Graphite Production)

| | |
|---|---|
| 2CO → CO2 + C | −173.7 kJ/mol |
| CO + H2 → C + H2O | −131.8 kJ/mol |
| CH4 → C + 2H2 | +74.5 kJ/mol |

Carburization (Cementite Production)

| | |
|---|---|
| 3Fe + CH4 → Fe3C + 2H2 | +98.3 kJ/mol |
| 3Fe + 2CO → Fe3C + CO2 | −148.8 kJ/mol |
| 3Fe + CO + H2 → Fe3C + H2O | −107.6 kJ/mol |

Hydrogen gas, either introduced into the direct reduction shaft or formed by the reactions above, also provides reduction of the iron ore by the following reactions:

| | |
|---|---|
| 6Fe2O3 + 2H2 → 4Fe3O4 + 2H2O | +32.7 kJ/mol |
| 2Fe3O4 + 2H2 → 6FeO + 2H2O | +127.6 kJ/mol |
| 6FeO + 6H2 → 6Fe + 6H2O | +171.4 kJ/mol |
| 2Fe3O4 + 8H2 → 6Fe + 8H2O | +299.0 kJ/mol |

Efforts towards reducing the environmental footprint of the traditional direct reduction process have typically focused on reducing the overall energy consumption of the process, thus reducing the quantity of natural gas required as input per ton output sponge iron. Proposals to decrease the amounts of fossil fuels used, and thus the CO2 emissions, have focused upon substituting part of the natural gas used in the process with renewable hydrogen and/or biofuels, leaving the overall process substantially unchanged. This however fails to recognise that a major proportion of carbon present in the process gas will not be incorporated in the sponge iron, but will instead act as a reductant in the direct reduction process, leading to formation of CO2. This CO2 is typically either captured and released, or reformed in an energy-intensive external reformation step that is heated by combustion of fossil fuels. Either way, the overall process results in poor utilization of the carbon introduced into the process, regardless of whether this carbon is from a fossil or renewable source. This is a critical consideration for the viability of any process seeking to replace fossil fuels with renewable fuels, since renewable fuels are typically less abundantly available than their fossil counterparts, and are considerably more expensive. In a process performed on the scale of ironmaking globally, availability and cost of fuels are key.

The present invention is based upon an insight by the inventors that performing a carburization reaction as a discrete process step has a number of advantages in the specific context of development of a steelmaking process with drastically reduced CO2 emissions.

The initial reduction of iron ore is performed in a carbon-lean reducing gas. This ensures that little or no CO2 is produced in the initial reduction step, and avoids the need for CO2 capture or reformation in conjunction with the reduction step. Since typically vast quantities of CO2 are otherwise produced during the reduction step, this entails a significant simplification in the plant required. The sponge iron intermediate produced in the reduction step is essentially carbon-free and is reduced to a significant extent. In the carburization unit, since the iron is already significantly reduced upon introduction, the balance of reactions is shifted towards reforming and/or carburizing reactions. This means that less of the carburizing gas is oxidized to CO2 and more carbon may be utilized by incorporation into the sponge iron, primarily as cementite. The balance of reactions may be shifted even further towards carburization by removing water from the carburization gas, thus decreasing the likelihood of hydrocarbon reforming reactions. Moreover, since the off-gas from the carburization reactor is not diluted with all of the gas required for reduction, it is therefore relatively concentrated: this means that the off-gas is easily treatable to remove any CO2 produced during the carburization step and to reuse the spent gas. A further advantage is that since carburization is performed as a discrete process step, greater flexibility is obtained with regard to choice of carburization gas and degree of carburization. The composition of the carburization gas and degree of carburization may be adapted freely without affecting the reduction process step.

In order to perform the process according to the present disclosure, a direct reduction shaft and a carburization unit are required.

Reduction

The direct reduction shaft may be of any kind commonly known in the art. By shaft, it is meant a solid-gas counter-current moving bed reactor, whereby a burden of iron ore is introduced at an inlet at the top of the reactor and descends by gravity towards an outlet arranged at the bottom of the reactor. Reducing gas is introduced at a point lower than the inlet of the reactor and flows upwards counter to the moving bed of ore in order to reduce the ore to metallized iron. Reduction is typically performed at temperatures of from about 900° C. to about 1100° C. The temperatures required are typically maintained by pre-heating of the process gases introduced into the reactor, for example using a preheater such as an electric preheater. Further heating of the gases may be obtained after leaving the pre-heater and prior to introduction into the reactor by exothermic partial oxidation of the gases with oxygen or air. Reduction may be performed at a pressure of from about 1 Bar to about 10 Bar in the DR shaft, preferably from about 3 Bar to about 8 Bar. The reactor may have a cooling and discharge cone arranged at the bottom to allow the sponge iron intermediate to cool prior to discharge from the outlet.

The iron ore burden typically consists predominantly of iron ore pellets, although some lump iron ore may also be introduced. The iron ore pellets typically comprise mostly hematite, together with further additives or impurities such as gangue, fluxes and binders. However, the pellets may comprise some other metals and other ores such as magnetite. Iron ore pellets specified for direct reduction processes are commercially available, and such pellets may be used in the present process. Alternatively, the pellets may be specially adapted for a carbon-lean reduction step, as in the present process.

The reducing gas is carbon-lean. By reducing gas it is meant the sum of fresh make-up gas plus recycled process (top) gas being introduced into the direct reduction shaft. By carbon-lean it is meant that no carbon reductant is introduced into the reducing gas circuit, i.e. the make-up gas introduced into the reducing gas circuit comprises no carbon reductant. By carbon reductant, it is meant carbon or carbon-containing compounds that are capable of directly acting as reductant, e.g. all non-fully oxidised carbon compounds, such as elemental carbon, hydrocarbons or carbon monoxide. For example, any make-up gas added to replenish the reducing gas may consist essentially of hydrogen gas. Note however that some quantities of carbon-containing gases may be present in the reducing gas. For example, if the outlet of the direct reduction shaft is coupled to the inlet of the carburization unit, relatively small quantities of carbon-containing gases may inadvertently permeate into the direct reduction shaft from the carburization unit. As another example, carbonates present in the iron ore pellets may be volatilized and manifest as CO2 in the top gas of the DR shaft, resulting in quantities of CO2 that may be recycled back to the DR shaft. Due to the predominance of hydrogen gas in the reducing gas circuit, any CO2 present may be converted by reverse water-gas shift reaction to CO. The carbon-lean reducing gas may comprise less than about 10 vol % (determined at normal conditions of 1 atm and 0° C.) of carbon-containing gases, preferably less than 5 vol %. The reducing gas may be predominantly hydrogen gas. The reducing gas entering the direct reduction shaft may consist of greater than 80 vol % hydrogen gas, preferably greater than 90 vol % hydrogen gas (vol % determined at normal conditions of 1 atm and 0° C.). The reducing gas may consist essentially of hydrogen gas together with gaseous by-products formed in the direct reduction shaft. The hydrogen gas may preferably be obtained at least in part by electrolysis of water. If the water electrolysis is performed using fossil-free and optionally renewable energy then this allows the provision of a reducing gas from such sources. The electrolytic hydrogen may be conveyed by a conduit directly from the electrolyser to the DR shaft, or the hydrogen may be stored upon production and conveyed to the DR shaft as required. As described below, hydrogen separated from the off-gas of the carburization unit may also be introduced to the DR shaft as reducing gas. The reducing gas may be recycled, whereby top (spent) gas from the DR shaft may be cleaned and treated to remove by-products such as water and/or dust prior to re-introduction to the DR shaft. This recycled gas may be mixed with fresh make-up gas prior to reintroduction into the reactor, or may be introduced separately from any fresh make-up gas supply.

Sponge Iron Intermediate

The sponge iron intermediate obtained at the outlet of the DR shaft is typically predominantly in the form of pellets, due to the structural integrity of the direct reduction pellets, as well as the conditions prevailing in the DR shaft. The degree of reduction of the obtained sponge iron intermediate depends on the processing conditions used in the DR shaft. It may be desirable to obtain a substantially fully metallized sponge iron intermediate, i.e. a sponge iron having a DoR greater than about 90%, such as greater than about 94%. It is often not commercially viable to obtain sponge irons having a DoR greater than about 96% due to reaction kinetics. A sponge iron intermediate having a high DoR helps ensure that very little CO2 may be produced in the subsequent carburization stage, thus potentially simplifying treatment of the off-gases from the carburization reactor. Alternatively, it may be desirable to obtain a sponge iron intermediate having a lesser degree of reduction, such as a DoR from about 50% to about 90%, preferably from about 60% to about 80%. The advantages of this are twofold. Since a shorter residence time is required in the DR shaft, the reactor may be dimensioned smaller. Moreover, at least some hydrogen gas produced during carburization will be consumed in reducing the sponge iron to its final high DoR (>90%), thereby potentially decreasing hydrogen accumulation during carburization and simplifying treatment and recycling of the carburization off-gas. Regardless of the degree of reduction of the sponge iron intermediate, it will have very low carbon content, since no carbon is introduced during the reduction stage. It will have carbon content of less than 0.5% by weight, preferably less than 0.05% by weight, even more preferably less than 0.0005% by weight.

Although the sponge iron from the reduction step is termed herein as an intermediate, it should be noted that this sponge iron need not necessarily be subjected to subsequent carburization and may instead be used directly in further metallurgical processes, such as in an electric arc furnace or for the production of wrought iron.

Carburization

The sponge iron intermediate is provided as an input to the carburization unit. The sponge iron intermediate may be provided hot to the carburization reactor, for example by discharging the output of the DR shaft directly to the carburization unit. This may assist in conserving energy and potentially decreases or avoids the need for heating in association with the carburization reaction. Alternatively, the sponge iron may be provided cooled to the carburization reactor, for example by storing the sponge iron intermediate prior to introduction into the carburization unit.

The carburization unit may preferably be a carburization shaft. As previously described, by shaft, it is meant a solid-gas countercurrent moving bed reactor. In this case sponge iron intermediate is introduced at the inlet of the reactor and a carburizing gas flows countercurrent to the moving sponge iron bed in order to carburize and optionally further reduce the sponge iron. A carburized sponge iron is obtained at the outlet of the reactor.

Alternatively, the carburization unit may be a conveyor unit or batch reactor. However, continuous reactors such as a carburization shaft are preferred.

The DR shaft and carburization unit may be coupled such that the outlet of the DR shaft is coupled directly to the inlet of the carburization unit, provided that an arrangement is provided to prevent carburization gas from permeating into the DR shaft to any significant extent. Such an arrangement may comprise a pressure differential between the reactors preventing permeation of carburization gas into the direct reduction shaft, and/or a lock or discharge device providing a physical barrier to gas transport into the direct reduction shaft. Alternatively, the DR shaft and carburization unit may be coupled by a shaft or chute, or may utilize further means to transport the sponge iron intermediate, such as one or more transport crucibles.

The carburizing gas may be any gas known or expected in the art to provide carburization. Gas in this respect refers to a substance that is gaseous at the high temperatures prevailing in the carburization reactor, although it may be liquid or solid at room temperature. Suitable carburization gases include hydrocarbons such as methane, natural gas, LPG or petroleum, or other carbonaceous substances such as syngas, lower (C1-C6) alcohols, esters and ethers. The carburizing gas may be of fossil origin, but it is preferable that it is obtained partly or wholly from a renewable source in order to reduce net CO2 emissions. By renewable it is meant a resource that is naturally replenished on a human timescale. The high utilization of carbon present in the carburizing gas permits use of renewable carburizing gases, despite their relative scarcity and high cost as compared to fossil equivalents. Suitable renewable carburizing gases include biomethane, biogas, gas obtained from the pyrolysis or partial combustion of biomass, lower alcohols or ethers such as methanol, DME or ethanol derived from renewable feedstocks, or combinations thereof. Sulfur-containing carburization gases may be used, as the sulfur is known to prevent nucleation of graphite and passivate the sponge iron product.

The composition of the carburizing gas may be chosen to suit the final carburized sponge iron to be obtained. The carburization reaction with hydrocarbons is relatively endothermic, leading to a relatively cool final product, whereas the reaction with CO-containing carburizing gases is more exothermic, leading to a hotter final product. This effect may be utilized to tailor the temperature of the final product obtained. For example, if a hot product is desired for briquetting (HBI), a gas comprising some partially oxidized carbon (e.g. in the form of CO, ketones, aldehydes) may be used, whereas if cold sponge iron (CDRI) is desired then biomethane may be used.

The carburization stage may be arranged to proceed to provide a sponge iron product having any desired carbon content. As discussed below, a desirable carbon content may typically be in the range of from about 1% by weight to about 3% by weight. This may be arranged by judicious choice of carburization process parameters including, but not limited to, residence time in the reactor, reaction temperature, reaction pressure, flow rate of carburizing gas and composition of carburizing gas. The temperatures required are typically maintained by pre-heating of the process gases introduced into the reactor, for example using a preheater such as an electric preheater. Further heating of the gases may be obtained after leaving the pre-heater and prior to introduction into the reactor by exothermic partial oxidation of the gases with oxygen or air. However, if hot sponge iron intermediate is introduced as feed into the carburization unit and a cool sponge iron product is desired then no preheater or partial oxidation may be necessary. The carburization unit may have a cooling and discharge cone arranged at the bottom to allow the sponge iron intermediate to cool prior to discharge from the outlet.

The spent carburization gas, or off-gas, may be treated to remove undesirable components and recycled back to the carburization reactor and/or reduction reactor. For example, hydrogen may be separated from the carburization off-gas and either stored or conveyed directly to the DR shaft for use as reducing gas. Such a separation may for example be performed using membrane separation techniques or pressure swing adsorption. The off-gas may undergo a reformation step to reform any CO2 formed during carburization to CO and/or CH4. Such a reformation step may be for example include utilizing the reverse water-gas shift reaction to convert CO2 and H2 to CO and H2O, utilizing the Sabatier reaction to convert CO2 and H2 to CH4 and H2O, utilizing co-electrolysis with CO2 and $H_2O$ as a feed to provide CO and H2, or combinations thereof. Alternatively, any CO2 formed during carburization may be captured and either stored (CCS), reformed, released or utilized for other purposes (CCU). Any water and/or dust in the carburization gas may be removed. The remaining gases, comprising mostly unreacted carburization gas and CO, may be recycled back to the carburization reactor. In order to improve the utilization of the resources used in the process, the carburization and reduction stages may be integrated in a variety of manners. For example, the hydrogen formed in the carburization stage may be used in the reduction stage as described above, or the CO2 formed in the carburization stage may be reformed to CO for further carburization. The off-gas from the carburization stage and/or top gas from the reduction stage may be fed through one or more heat exchangers in order to pre-heat gases to be introduced into the reactor.

Sponge Iron

The term crude iron is used herein to denote all irons produced for further processing to steel, regardless of whether they are obtained from a blast furnace (i.e. pig iron), or a direct reduction shaft (i.e. sponge iron). The sponge iron exiting the outlet of the carburization unit is typically in pellet form and such sponge iron is typically referred to as direct reduced iron (DRI). Depending on the process parameters, it may be provided as hot (HDRI) or cold (CDRI). Cold DRI may also be known as Type (B) DRI. DRI may be prone to re-oxidation and in some cases is pyrophoric. However, there are a number of known means of passivating the DRI. One such passivating means commonly used to facilitate overseas transport of the product is to press the hot DRI into briquettes. Such briquettes are commonly termed hot briquetted iron (HBI), and may also be known as type (A) DRI.

The sponge iron product obtained by the process herein may be an essentially fully metallized sponge iron, i.e. a sponge iron having a degree of reduction (DoR) greater than about 90%, such as greater than about 94% or greater than about 96%. Degree of reduction is defined as the amount of oxygen removed from the iron oxide, expressed as a percentage of the initial amount of oxygen present in the iron oxide. It is often not commercially favourable to obtain sponge irons having a DoR greater than about 96% due to reaction kinetics, although such sponge irons may be produced if desired.

The carbon present in the sponge iron product may typically be in the form of cementite (Fe3C) and/or graphite. Graphite tends to dust and to be lost from the sponge iron prior to reaching the melt of the EAF. For this reason, a high proportion of cementite is preferable in the sponge iron. Due to the control provided by performing carburization as a separate step, sponge irons having a high cementite/graphite ratio are obtainable by the present method. By high cementite/graphite ratio it is meant that the mass fraction of carbon present as cementite in the sponge iron product is greater than 70%, such as greater than 80%, preferably greater than 90%.

Sponge iron having any desired carbon content may be produced by the process described herein, including carbon contents exceeding the theoretical carbon content of cementite (6.69%) if carbon is also present in the sponge iron as graphite. However, it is typically desirable for further processing that the sponge iron has a carbon content of from 0.5 to 5 percent carbon by weight, preferably from 1 to 4 percent by weight, such as about 3 percent by weight, although this may depend on the ratio of sponge iron to scrap used in a subsequent EAF processing step.

It is preferred that the carburizing gas is derived from a renewable source, and in such case, the carbon in the sponge iron product will also derive from a renewable source. It can be determined whether the carbon in the sponge iron derives from a renewable source or a fossil source by radiocarbon dating of the sponge iron. Methods for sample preparation and radiocarbon dating of iron products are known in the art. For example, an appropriate method is disclosed in Cook, A., Wadsworth, J., & Southon, J. (2001). AMS Radiocarbon Dating of Ancient Iron Artifacts: A New Carbon Extraction Method in Use at LLNL. Radiocarbon, 43(2A), 221-227, the methods of which are incorporated by reference herein.

Carbon derived from fossil resources typically has a radiocarbon age of in excess of 35 000 years, whereas carbon derived from renewable sources is found to be "modern". Depending on the proportion of renewable carbon to fossil carbon in the sponge iron, which in turn depends on the proportion of renewable carbon to fossil carbon in the carburizing gas, the radiocarbon age of the sponge iron may range from about 35 000 years (if the carburizing gas is exclusively fossil-derived) to "modern" (if the carburizing gas is exclusively renewable-derived). A list of radiocarbon dated iron objects is provided in Cook, A. C., Southon, J. R. & Wadsworth, J. Using radiocarbon dating to establish the age of iron-based artifacts. JOM 55, 15-22 (2003). The process described herein, due to its excellent utilization of carbon, is capable of being performed in a commercially viable manner using a carburization gas derived predominantly or essentially from renewable sources. Thus the resulting sponge iron product may have a radiocarbon age of less than 10 000 years before present, preferably less than 1 000 years, such as less than 100 years before present.

Embodiments

The invention will now be described in more detail with reference to certain exemplifying embodiments and the drawings. However, the invention is not limited to the exemplifying embodiments discussed herein and/or shown in the drawings, but may be varied within the scope of the appended claims. Furthermore, the drawings shall not be considered drawn to scale as some features may be exaggerated in order to more clearly illustrate certain features.

FIG. 1 schematically illustrates an exemplifying embodiment of the ore-based steelmaking value chain according to the Hybrit concept. The ore-based steelmaking value chain starts at the iron ore mine 101. After mining, iron ore 103 is concentrated and processed in a pelletizing plant 105, and iron ore pellets 107 are produced. These pellets, together with any lump ore used in the process, are converted to sponge iron intermediate 108 by reduction in a direct reduction shaft 111 using hydrogen gas 115 as the main reductant and producing water 117 as the main by-product. The hydrogen gas 115 is produced primarily by electrolysis of water 117 in an electrolyser 119 using electricity 121 from a fossil-free or renewable source 122. The hydrogen gas 115 may be stored in a hydrogen storage 120 prior to introduction into the direct reduction shaft 111. In accordance with the present disclosure, it is desired that the sponge iron comprises carbon, preferably renewable carbon. Therefore, the sponge iron intermediate 108 obtained from the direct reduction shaft 111 is fed to a carburization unit, herein illustrated as a carburization shaft 113. In the carburization shaft 113 the sponge iron intermediate 108 is treated with a carburizing gas 114, thus providing a carburized sponge iron 109. The carburized sponge iron 109 is then melted using an electric arc furnace 123, optionally together with a proportion of scrap iron 125 or other iron source, to provide a melt 127. The electricity 121 used in the electric arc furnace 123 preferably comes from a fossil-free and optionally renewable source 122. The melt 127 is subjected to further downstream secondary metallurgical processes 129, and steel 131 is produced.

Figure 2A:
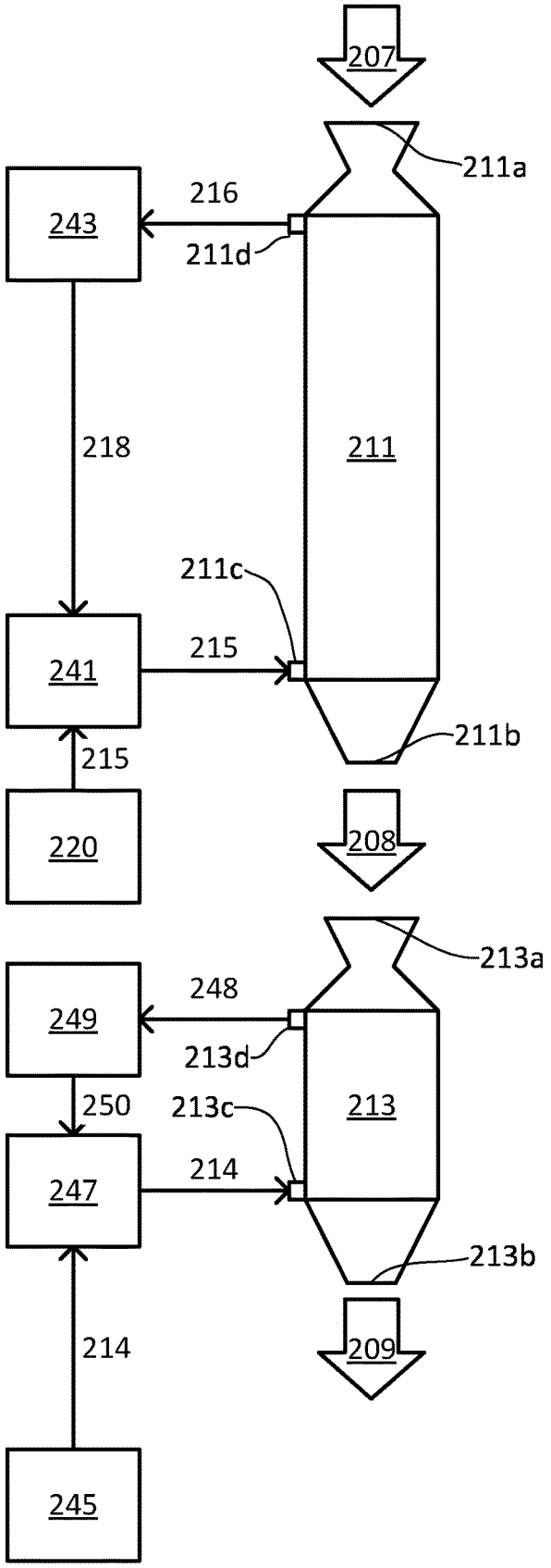
FIG. 2*a* schematically illustrates an exemplifying embodiment of a system suitable for performing a process as disclosed herein.

FIG. 2*a* schematically illustrates an exemplifying embodiment of a system suitable for performing the process as disclosed herein.

A direct reduction shaft 211 is arranged with an inlet 211*a* for iron ore 207, an outlet 211*b* for discharging sponge iron intermediate 208, an inlet for reducing gas 211*c* and an outlet for top gas 211*d*. In use, iron ore 207 is introduced into inlet 211*a* and progressively passes through the reactor to be discharged at outlet 211*b*. During its passage through the reactor 211 the ore 207 is reduced by reducing gas 215 in a counter-current flow, such that the ore 207 is reduced to sponge iron intermediate 208 at the discharge outlet 211*b* of the reactor 211.

Reducing gas 215 is supplied from a source of reducing gas 220, such as a hydrogen gas store or water electrolyser. The reducing gas 215 is passed through a pre-heater 241 prior to introduction into the direct reduction shaft 211. The top gas 216 exiting outlet 211*d* is passed through a plurality of treatment apparatuses 243 in order to prepare the gas for re-introduction to the DR shaft 211. The plurality of treatment apparatuses may include a cleaning step, such as passage through an electrostatic precipitator to remove solids from the gas, heat exchange with other process gases such as the reducing gas 215, and separation of water. The treated top gas 218 is mixed with the reducing gas 215 and passed through the pre-heater 241 prior to reintroduction into the direct reduction shaft 211 through inlet 211*c*. The temperature of the gases entering inlet 211*c* may be further increased by partial oxidation or electric heating. In such a case, a supply of oxygen or electric gas heater (not shown) will be arranged between the pre-heater 241 and inlet 211*c*.

A carburization unit, herein illustrated as a carburization shaft 213 is arranged with an inlet 213*a* for sponge iron intermediate 208, an outlet 213*b* for discharging carburized sponge iron intermediate 209, an inlet for carburizing gas 213*c* and an outlet for off-gas 213*d*. In use, the sponge iron intermediate 208 from direct reduction shaft 211 is introduced into carburization shaft 213 via carburization shaft inlet 213*a*. During its passage through the reactor 213 the intermediate 208 is carburized by carburizing gas 214 in a counter-current flow, such that carburized sponge iron 209 is obtained at the discharge outlet 213*b* of the reactor 213.

Carburizing gas 214 is supplied from a source of carburizing gas 245, such as a biomass gasifier. The carburizing gas 214 is passed through a pre-heater 247 prior to introduction into the carburization shaft 213. The off-gas 248 exiting outlet 213*d* is passed through a plurality of treatment apparatuses 249 in order to prepare the gas for re-introduction to the carburization shaft 213. The plurality of treatment apparatuses may include a cleaning step, such as passage through an electrostatic precipitator to remove solids from the gas, heat exchange with other process gases such as the carburizing gas 214 or reducing gas 125, and separation of by-products such as hydrogen, carbon dioxide and/or water. The treatment apparatuses may further include an apparatus arranged to convert any CO2 from the off-gas to CO and/or CH4. Such an apparatus may be for example a reformer utilizing the reverse water-gas shift reaction to convert CO2 and H2 to CO and H2O, or it may be a co-electrolysis unit utilizing CO2 and H2O as a feed to provide CO and H2. The treated off-gas, together with any reformed CO2 from the off-gas, 250 is mixed with the carburizing gas 214 and passed through the pre-heater 247 prior to reintroduction into the carburization shaft 213 through inlet 213*c*. The temperature of the gases entering inlet 213*c* may be further increased by partial oxidation or electric heating. In such a case, a supply of oxygen or electric gas heater (not shown) will be arranged between the pre-heater 247 and inlet 213*c*.

Figure 2B:
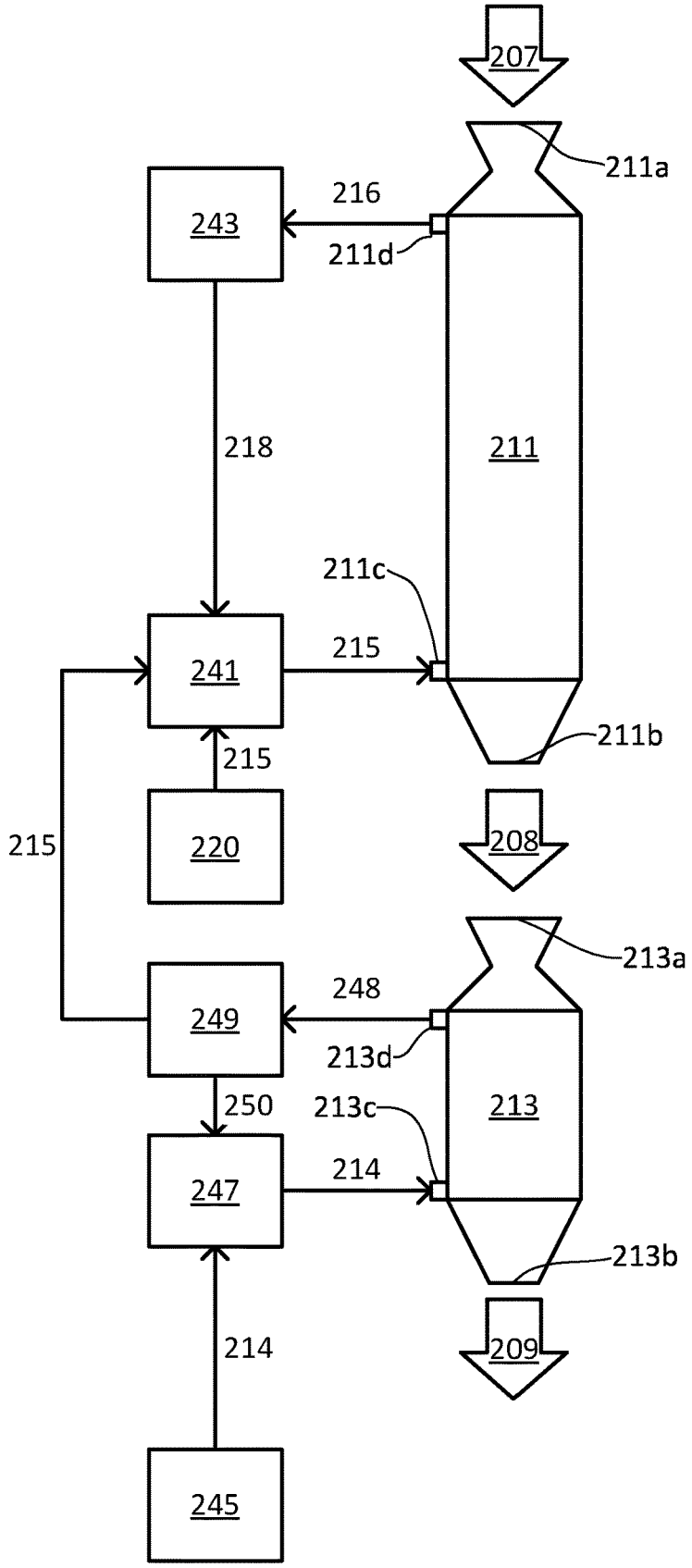
FIG. 2*b* schematically illustrates another exemplifying embodiment of a system suitable for performing a process as disclosed herein.

FIG. 2*b* schematically illustrates a similar process system to that illustrated in FIG. 2*a*, with the difference that hydrogen gas 215 separated from carburization off-gas 248 is provided to preheater 241 for use as reducing gas in the direct reduction shaft 211.

Figure 2C:
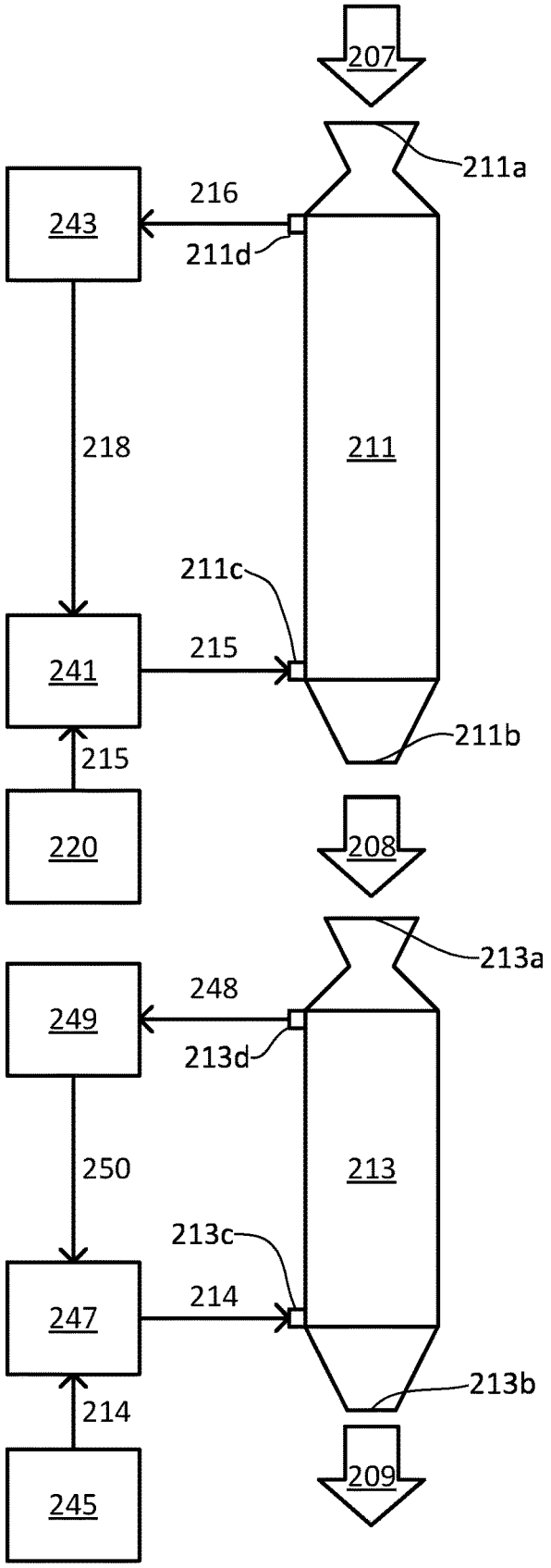
FIG. 2*c* schematically illustrates a further exemplifying embodiment of a system suitable for performing a process as disclosed herein.

FIG. 2*c* schematically illustrates a similar process system to that illustrated I FIG. 2*a*, with the difference that the relative proportions of the direct reduction shaft 211 and carburization shaft 213 are altered somewhat. It is envisaged that the reduction process parameters in the direct reduction shaft 211 are adapted to provide a sponge iron intermediate 208 having a lower degree of reduction, such as between 60% and 80%. The carburization shaft 213 is relatively large since it is dimensioned to provide reduction of the sponge iron intermediate to a high degree of reduction, over and above its normal purpose of carburization. The reduction in the carburization shaft 213 consumes at least part of the hydrogen gas formed as a by-product of carburization, and may decrease or eliminate the need for separation of hydrogen from the off-gas 248.

In all of the embodiments illustrated, a pre-heater 247 is used to pre-heat carburization gas entering the carburization shaft 213. However, depending on the type of sponge iron desired, a pre-heater 247 may not be required. For example, if producing DRI then a relatively cold carburized sponge iron may be desired. This may be achieved by using a carburization gas providing an endothermic carburization reaction, such as (bio)methane, and by not preheating the carburization gas. In such a case, a preheater 247 is not required apparatus.

Figure 3:
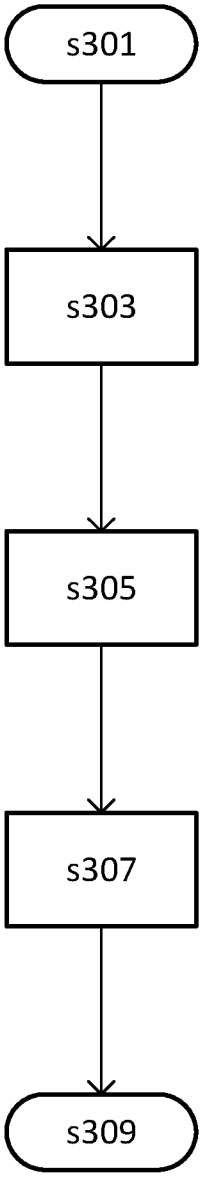
FIG. 3 is a flow chart schematically illustrating an exemplifying embodiment of a process as disclosed herein.

FIG. 3 is a flow chart schematically illustrating an exemplifying embodiment of the process disclosed herein. Step s301 denotes the start of the process. In step s303 iron ore is reduced using a carbon-lean reducing gas in a direct reduction shaft to provide a sponge iron intermediate. The reduction may be performed to near-completion, providing an intermediate with a high degree of reduction, i.e. in excess of 90%, or it may be performed only partially, providing a less reduced intermediate, i.e. a DoR between 60-90%. In step s305 the sponge iron intermediate is transferred to a carburization unit. In step s307 the sponge iron intermediate is carburized in the carburization unit using a carburizing gas to provide carburized sponge iron. If a less reduced intermediate is used as the feed to the carburization unit, the reduction will also proceed to near-completion in the carburization unit, providing a highly reduced carburized sponge iron. Step s309 denotes the end of the process.

In one exemplifying embodiment of the process, DRI is produced as the carburized sponge iron by using methane or biomethane as the carburizing gas. In another exemplifying embodiment of the process, HBI is produced by using a biogas comprising partially oxidized carbon, followed by a briquetting step where the hot carburized sponge iron is briquetted.

Examples

Figure 4:
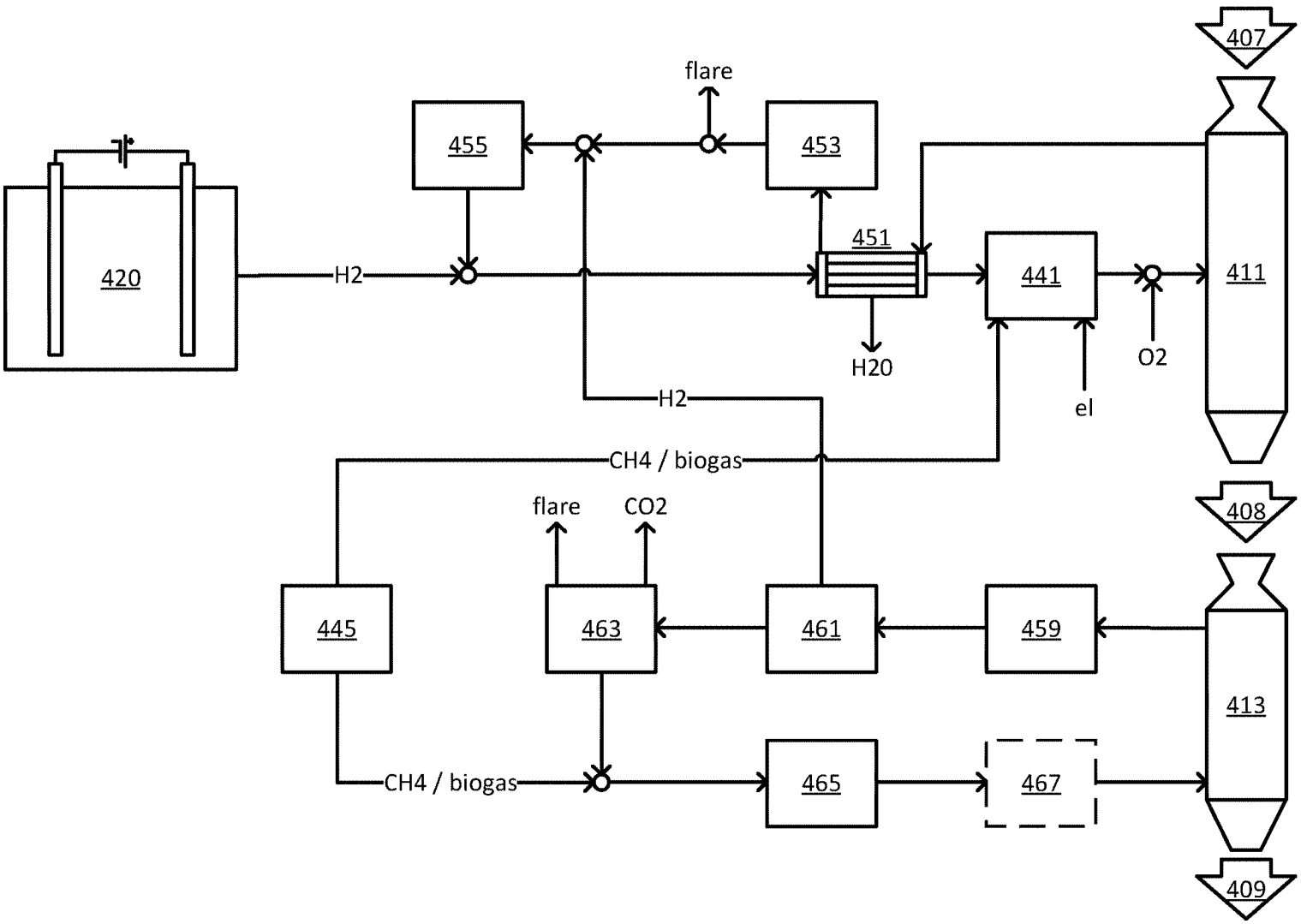
FIG. 4 schematically illustrates a model system upon which calculations were based.

Using a proprietary model, a system for the production of sponge iron as illustrated in FIG. 4 was modelled, and the mass- and energy-balances calculated. The illustrated components are:

407 Iron ore pellets
408 Intermediate sponge iron
409 Carburized sponge iron
411 Direct reduction shaft
413 Carburization shaft
420 Electrolyser
441 Preheater
445 Biomethane/biogas source
451 Heat exchanger
453 Top gas purification
455 Compressor
459 Off-gas purification
461 Hydrogen separation
463 CO2 separation
465 Compressor
467 Preheater The calculations were based on input of 1400 kg standard LKAB DR pellets (including moisture) per tonne produced DRI. The DRI was calculated to have a degree of reduction of 95.8% and a degree of metallisation of 94% unless otherwise stated. The degree of carburization of the final sponge iron product was 2%.

Three different scenarios were calculated:

Scenario 1 using H-DR followed by separate carburization using biomethane;

Scenario 2 using H-DR followed by separate carburization using a biomethane/biogas blend;

Scenario 3 using H-DR to only 75% DoR, followed by separate carburization/reduction using biomethane.

A reference scenario based on a prior-art natural gas-based direct reduction process was also calculated for comparative purposes. The reference scenario is a fully natural gas-based process and was calculated using an adapted version of the model described above, in combination with key parameters retrieved from the published literature.

The total amount of gas entering the direct reduction shaft is approximately the same for all calculated scenarios. It is only the composition of the gas that differs, depending on whether the reduction is based on hydrogen gas or natural gas.

Scenario 1: Hydrogen Reduction with Separate Carburization Using Biomethane

Hydrogen gas is used as the sole reductant. A constant addition of hydrogen from electrolyser 420 is required to the reducing gas circuit, since hydrogen is consumed in reducing the iron ore. The water resulting from the reduction reaction is removed from the top gas in heat exchanger 451. The calculations show that the top gas of the reduction shaft consists only of hydrogen, nitrogen and water, and 72% can be recirculated back to the reduction shaft after water removal. No CO2 is produced in the reduction and therefore no CO2 removal system is necessary from the reduction circuit. The reducing gas is first preheated in heat exchanger 451, then heated electrically to 900° C., followed by further heating to 1050° C. by partial oxidation using oxygen from the electrolysers.

Carburization is performed using biomethane as the reducing gas. The amount of biomethane required for carburization is less than a quarter of the amount of natural gas used in the reference scenario. Hydrogen gas is produced as a by-product in the carburization reactor and is separated in unit 461. This hydrogen gas may be added to the reduction gas circuit prior to compressor 455, leading to at least an 11% decrease in the amount of hydrogen required from electrolysis. The carburization off-gas is essentially free of $CO_2$ and therefore there is no need for $CO_2$ separation unit 463 in this scenario.

Scenario 2: Hydrogen Reduction with Separate Carburization Using Biogas

This scenario is similar to Scenario 1 above; however, instead of using biomethane as the carburizing gas, a blend of biomethane and biogas is used. For the purpose of calculation, the blend is taken to be 50/50 biogas to biomethane. Note however that the exact composition of the carburizing gas may be varied. The major difference as compared to Scenario 1 is in the carburizing circuit. Since the carburizing reaction with methane is endothermic whereas carburization with CO (from biogas) is exothermic, a larger flow of carburizing gas is required in order to obtain a cold DRI product. Moreover, some CO2 is produced in the carburization reaction and therefore CO2 separation is required. Therefore, approximately 5% of the off-gas exiting the carburization shaft is separated in unit 463.

Note however, that although CO2 separation is required, the flow of off-gas passing through the CO2 separation unit 463 is less than 20% of the corresponding volume of top gas requiring CO2 separation in the natural gas-based reference scenario. This makes the CO2 separation step both simpler and less energy-demanding. Moreover, the amount of CO2 produced in the reference scenario is at least 9 times greater than the CO2 produced in Scenario 2.

Scenario 3: Lesser Degree of Reduction in the Reduction Shaft, Followed by Separate Carburization/Reduction in the Carburization Shaft Using Biomethane Scenario 3 is similar to Scenario 1 above, except that the degree of reduction in the reduction shaft is set to 75% instead of 95.8%. This means that that the hydrogen gas requirement to the reduction circuit is decreased by 17%. Final reduction and carburization is performed in carburization shaft 413. This requires that the carburizing gases are heated prior to entering the carburization shaft. The model used cannot take into account further reduction in the carburization shaft. However, from Scenario 1 it is known that carburization of the sponge iron in the carburization shaft produces hydrogen gas equivalent to 11% of the total hydrogen demand of the reduction circuit. It is conceivable that this hydrogen gas in Scenario 3 may instead react with the less reduced sponge iron in the carburization shaft, providing a final reduction concurrently with carburization. The advantage of such a process is that increased productivity may be achieved in the reduction circuit, meaning that either the dimensions of the reduction shaft may be decreased, or the throughput increased. As mentioned previously, such a Scenario is also beneficial in being able to provide increase flexibility and responsiveness with regard to supply of fossil-free/renewable energy. A disadvantage is that carbon dioxide will be produced in the carburization shaft, which will necessitate separation by unit 463. However, it is conceivable that the separated CO2 may be converted to CO and reintroduced into the carburization shaft.

Summary of Modelled Scenarios

Thus, to summarize, Scenario 1 provides a carburized sponge iron without any concomitant production of CO2. The amount of biomethane required for carburization is less than a quarter of the amount of natural gas used in the reference scenario. Even Scenarios 2 and 3, both of which result in some CO2 production requiring separation of CO2 from the carburization off-gas, are favourable compared to the natural-gas based reference scenario. The amount of CO2 produced in the reference scenario is at least 9 times greater than the CO2 produced in Scenario 2, and the volume of gas requiring treatment in the reference scenario is more than 5 times greater.

In each of scenarios 1 to 3, since no fossil coal is introduced into the process and carburization is achieved using biomethane/biogas from biogenic sources, the sponge iron produced will have a radiocarbon age equal to the radiocarbon age of the biogenic source of biomethane/biogas. The exact radiocarbon age will depend on the biomass used to produce biomethane/biogas, but will most likely be less than 100 years before present (depending on rotation age), and will most definitely be less than 1000 years before present. In contrast, the reference scenario used only natural gas, i.e. a fossil fuel, in the carburization of the sponge iron. Also, in this scenario the radiocarbon age of the carburized sponge iron will equal the radiocarbon age of the carburizing gas, but since in this scenario the carburizing gas is natural gas, the sponge iron will have a radiocarbon age of about 30 000-35 000 years before present.

The invention claimed is:

1. A process for the production of carburized sponge iron (109, 209), the process comprising the steps:

reducing (s303) iron ore (107, 207) using a carbon-lean reducing gas (115, 215), said carbon-lean reducing gas comprising less than about 10 vol % of carbon-containing gases, in a direct reduction shaft (111, 211) to provide a sponge iron intermediate (108, 208), wherein the sponge iron intermediate has a degree of reduction from about 60% to about 80%;

transferring (s305) the sponge iron intermediate to a carburization unit (112, 213); and carburizing (s307) the sponge iron intermediate in the carburization unit using a carburizing gas (114, 214) to provide carburized sponge iron.

2. The process according to claim 1, wherein the carburizing gas is derived from a renewable source.

3. The process according to claim 1, wherein the carburizing gas comprises bio-methane, biogas, gas from the pyrolysis of biomass, or a combination thereof.

4. The process according to claim 1, wherein the reducing gas comprises hydrogen produced by electrolysis.

5. The process according to claim 1, wherein hydrogen is separated from an off-gas (248) from the carburization unit.

6. The process according to claim 1, wherein carbon dioxide produced in the carburizing step is separated from an off-gas (248) from the carburization unit.

7. The process according to claim 1, wherein the carburization gas is pre-heated by heat exchange with an off-gas (248) from the carburization unit, and/or wherein the carburizing gas is mixed with an off-gas from the carburization unit prior to introduction into the carburization unit.

8. The process according to claim 1, wherein the sponge iron intermediate is transferred to the carburization unit at a temperature in excess of about 500° C.

9. The process of claim 5, wherein the hydrogen separated from the off-gas is introduced as reducing gas into the direct reduction shaft.

10. The process of claim 6, wherein the carbon dioxide is converted into carbon monoxide and introduced as a carburizing gas into the carburization unit.

* * * * *